US006100644A

United States Patent [19]

Titus

[11] Patent Number: 6,100,644

[45] Date of Patent: Aug. 8, 2000

[54] DIMMABLE AND NON-DIMMABLE ELECTRONIC BALLAST FOR PLURAL FLUORESCENT LAMPS

[76] Inventor: Charles H. Titus, 323 Echo Valley La., Newtown Square, Pa. 19073

[21] Appl. No.: 09/301,803

[22] Filed: Apr. 29, 1999

[51] Int. Cl.[7] ..... H05B 37/00

[52] U.S. Cl. ..... 315/209 R; 315/219; 315/224; 315/276

[58] Field of Search ..... 315/219, 200 R, 315/209 R, 224, 276, 210

[56] References Cited

U.S. PATENT DOCUMENTS

| | | | |
|---|---|---|---|
| 4,538,095 | 8/1985 | Nilssen | 315/244 |
| 4,675,576 | 6/1987 | Nilssen | 315/242 |
| 4,698,554 | 10/1987 | Stupp et al. | 315/307 |
| 5,173,643 | 12/1992 | Sullivan et al. | 315/276 |
| 5,192,896 | 3/1993 | Qin | 315/224 |
| 5,192,897 | 3/1993 | Vossough et al. | 315/308 |
| 5,233,273 | 8/1993 | Waki et al. | 315/224 |
| 5,323,090 | 6/1994 | Lestician | 315/291 |
| 5,334,915 | 8/1994 | Ohsaki et al. | 315/307 |
| 5,363,020 | 11/1994 | Chen et al. | 315/209 R |
| 5,371,438 | 12/1994 | Bobel | 315/200 R |
| 5,539,281 | 7/1996 | Shackle et al. | 315/224 |
| 5,825,137 | 10/1998 | Titus | 315/291 |

*Primary Examiner*—David Vu

*Attorney, Agent, or Firm*—Caesar, Rivise, Bernstein, Cohen & Pokotilow, Ltd.

[57] ABSTRACT

An electronic ballast has a unique inverter design which eliminates a large percentage of the required components, thereby simplifying and increasing the reliability of the ballast, while decreasing its costs. The ballast can operate both as a non-dimmable ballast and a dimmable ballast. The ballast can provide power for either two or four fluorescent lamps in a single light fixture, or for a plurality of such light fixtures connected in a daisy chain fashion. The ballast incorporates additional safety and protection features which are not available in existing ballasts, such removing the lethal danger of the 50/60 Hz power that is typically present at the lamps during lamp replacement. Furthermore, the electronic ballast supplies a constant high frequency output voltage to the light fixture independent of the frequency. There is very little distributed capacitance at the connections from the electronic ballast to the lamps. This feature eliminates points of resonances over the range of frequencies for dimming, thereby eliminating sudden changes in brightness as the frequency is varied.

34 Claims, 5 Drawing Sheets

DIMMABLE AND NON-DIMMABLE ELECTRONIC BALLAST FOR PLURAL FLUORESCENT LAMPS

BACKGROUND OF THE INVENTION

This invention relates generally to electronic ballasts for fluorescent lamps, and more particularly to electronic ballasts for fluorescent lamps, which operate in the high frequency range and which provide both for both dimmable and non-dimmable lighting operation.

Various types of electronic ballasts are known. Magnetic ballasts operate at the frequency of the input power sources, e.g., at 50 or 60 Hz. In recent years, it has been recognized that a considerable increase in efficiency, i.e., the amount of power expended in relation to the lumen output of fluorescent lights, can be obtained, in the order of 40%, if the lamps are operated at higher frequencies, e.g., at frequencies between 30 and 50 KHz.

These electronic ballasts comprise an input circuit with surge protection, a thermal switch for protection against equipment failures or short circuits, and a noise filter circuit; a full wave rectifier, usually a diode bridge with a smoothing filter across its output; an inverter with an amplifier and a second DC power supply; and an output transformer which is connected to the fluorescent lamps.

The most common fluorescent lamp ballasts are non-dimmable. They have no manual control of the amount of light emitted by the fluorescent lamps. But recently, dimmable types of high frequency ballasts have been disclosed which use a voltage to frequency converter, an amplifier, and a second DC power supply in the inverter, and apply power to the lamps over a frequency range. One such electronic dimmable ballast is disclosed in U.S. Pat. No. 5,192,897 (Vossough et al.). The lamp brightness varies in proportion to the frequency of the power applied to the lamps.

A problem with many of the existing ballasts is that the secondary of the output transformer, which is connected to the lamps is not fully isolated from the primary of the transformer, allowing for a feed back path to the AC power source. This creates a hazardous condition when lamps are being changed because the exposed socket can carry 50 or 60 Hz power. Whereas high frequency power (in the order of 30 to 50 KHz) can cause a burn if the skin is exposed to it, 50 to 60 Hz power can cause shock or electrocution.

In addition, conventional fluorescent ballasts operate one fluorescent lamp, or possibly two fluorescent lamps, but no more than that. Thus, the present invention, as will be discussed later, provides the means for operating at least two, if not more, fluorescent lamps from a single ballast.

The following U.S. patents are related to discharge lights or fluorescent lighting ballasts, such as: U.S. Pat. Nos. 5,363,020 (Chen et al.); U.S. Pat. No. 4,698,554 (Stupp et al.); U.S. Pat. No. 5,233,273 (Waki et al.); U.S. Pat. No. 5,334,915 (Ohsaki et al.); U.S. Pat. No. 5,323,090 (Lestician). However, none of these patents supply a single variable frequency control circuit to control the light intensity of one or more ballasts with each ballast capable of operating two to four lamps in a single lighting fixture. In addition, all of the ballast circuits shown in these patents have some form of "on-board" oscillator with feedback control. This feedback control is required for proper operation of their respective ballasts and, without it, would fail to operate. Furthermore, the '554 patent, the '273 patent and the '915 patent have the lamp terminals connected to the 120/277 volt (60 Hz) power supply, thereby creating a shock hazard. In contrast, as will be discussed below, the present invention does not use any type of feedback which makes the present invention a simple, reliable device which uses less than ½ the components used in the above-cited patents. Furthermore, the present invention also provides electrical isolation from the 50/60 Hz power system, which also makes the present invention inherently safe from shock hazard.

The reason a feedback circuit is added to the base frequency power system in a conventional ballast, or those cited above, is to automatically make an adjustment or change in the voltage, current or frequency of the power which is being used to light the fluorescent lamps or to correct a short coming in the basic design in one or more circuit in the lamp ballast. Other reasons for utilizing feedback circuits in lamp ballasts are: (1) trying to maintain constant current to the lamps if voltage input to the ballast varies since some high frequency ballast power circuits may amplify any utility voltage variation and therefore a feedback circuit is used to correct for the variation; (2) fluorescent lamps require more voltage to start the electrical discharge in the lamp and then a feedback system may be necessary to make corrections when the lamp is lit; (3) some AC-DC power conversion systems in the ballasts require feedback circuits to provide the desired voltage and current to light the lamps; and (4) to assure that the electrical ballast output does not vary even when the electric utility voltage is varying. In contrast, the present invention, as will be discussed later, does not utilize any sort of feedback.

In addition, the ballast of U.S. Pat. No. 5,233,273 (Waki et al.) pertains to the starting and control of a single discharge lamp of the type used in commercial buildings and outdoor lighting whereas the present invention is designed for a plurality of fluorescent lamps. In particular, the ballast circuit of the '273 patent applies only to a metal halide type of discharge lamp that is physically and electrically different in construction (e.g., there are no filaments) than fluorescent lamps. Furthermore, discharge lamps require much higher voltages to "turn on" (e.g., thousands of volts to create the initial breakdown) as opposed to fluorescent lamps which require a much smaller voltage since fluorescent lamps utilize a continuously heated filament at both ends of the lamp. Metal halide discharge lamps require a first formation of an initial breakdown of the gases in the lamp, then a "hot spot" forms which later transitions to an arc between the electrodes and it is the arc discharge in the metal halide lamp that produces the light; in contrast, the fluorescent lamps used in the present invention do not operate at all like metal halide lamps. In addition, connecting the electronic ballast of the '273 patent to one or more fluorescent lamps would result in, at best, a very short life of the fluorescent lamp. In particular, the sockets installed in the fluorescent lamp fixtures would not be able to withstand the high voltage which is necessary to light a metal halide lamp. The '273 patent ballast requires a pulse voltage and, thus, a pulse transformer, neither of which is necessary or desirable for a fluorescent lamp. Furthermore, the '273 patent ballast uses a series resonant circuit whereas the present invention does not utilize such a circuit. The '273 patent must use a lamp current detector whereas the present invention does not utilize a lamp current detector. Furthermore, the '273 patent ballast requires the use of a feedback signal to control its oscillator in order for the ballast to work properly whereas the present invention ballast circuit requires no lamp feedback nor any other type of feedback to control the high frequency signal or the lamp intensity. As a result, the present invention is less complex, requires fewer parts and provides a lower cost to manufacture.

U.S. Pat. No. 4,698,554 (Stupp et al.) discloses a ballast that includes no isolation transformer and, as a result, power frequency voltage and DC power are available at the fluorescent tube sockets, thereby creating a shock hazard. In addition, the '554 patent ballast uses one filament transformer for powering the lamp filaments, whereas the fluorescent lamp filaments in the present invention are powered from the output transformer which also isolates the fluorescent lamp sockets from utility power for safety. The '554 patent ballast also controls lamp current and light intensity by varying frequency using a feedback system, resulting in more components than required by the present invention.

The '020 patent ballast also contains a feedback signal processor and power factor controller, as well as other expensive components. In contrast, the present invention does not utilize any pulse width modulation, no power controller and no feedback signal processor nor power factor controller.

The '915 patent ballast uses a controlled chopper circuit and an inverter circuit. The chopper circuit controls the DC voltage to the inverter which, in turn, provides the high frequency current to the fluorescent lamp. After the lamp is lighted, then the chopper control provides the desired amount of DC current to the inverter which, in turn, provides the proper higher frequency current to the fluorescent light. In contrast, none of this control circuitry is utilized in the present invention. Furthermore, the high frequency voltage is terminated when the lamp tube is removed from the '915 patent ballast. In contrast, the high frequency voltage is still present when a lamp tube is removed from the present invention but the power frequency from the utility is isolated; thus, in the present invention, the power is not shut off when one lamp tube is removed, thereby allowing one ballast to continue to power the remaining lamps if one is removed while still providing the shock isolation.

The '090 patent discloses an electronic ballast system including one or more gas discharge lamps without standard filaments; the filaments are replaced with unconnected single electrodes. This patent shows the use of isolation transformers between the ballast circuit and the lamps; however, like the other references, this ballast also uses lamp circuit feedback.

Other lamp ballast circuits that utilize feedback are:

U.S. Pat. No. 4,538,095 (Nilssen) discloses an electronic ballast circuit that utilizes a feedback circuit, namely circuit A shown in FIG. 1 of that patent.

U.S. Pat. No. 4,675,576 (Nilssen) discloses an electronic ballast that does not utilize an isolation transformer but does utilize a feedback circuit DA for disabling the high frequency power; however, it is the low frequency (50/60 Hz) utility power that is fatal and which is not disabled by that circuit.

U.S. Pat. No. 5,173,643 (Sullivan et al.) discloses a dimmable ballast that utilizes five feedback circuits: a feedback circuit that makes it easier to set the light intensity when the intensity is low; a second feedback circuit is used to control lamp current; a third feedback circuit is used for shutting off the dimming circuit when the voltage is too high; a fourth feedback circuit is used for shutting down the dimming circuit if the ground fault is too high; and a fifth feedback circuit is used for detecting out-of-phase current which flows through the lamps so that sufficient in-phase current is always available to the lamp. In contrast, the present invention does not require any of these.

U.S. Pat. No. 5,192,896 (Qin) discloses an electronic ballast that effectively implements feedback by sensing over-voltage to prevent damage to the ballast or lamps. In contrast, the present invention does not utilize any type of over-voltage sensing.

U.S. Pat. No. 5,539,281 (Shackle et al.) discloses a dimmable ballast that utilizes boost or buck voltage to control lamp power, none of which is used by the present invention.

U.S. Pat. No. 5,825,137 (Titus) discloses non-dimmable and dimmable electronic ballasts for controlling at least two or more fluorescent lamps without any feedback circuitry.

While some prior art electronic ballasts may be generally suitable for their intended purposes, they nevertheless leave something to be desired from one or more of the following standpoints: safety, reliability, ability to provide power to multiple lamps, simplicity of construction, and cost. Many of these prior art electronic ballasts involve complex circuitry due to the fact that they use feedback. Furthermore, there is a need for dimmable ballasts which protect against points of resonance over the range of input frequencies, which cause "blooming" (increased brightness, then dimming), at specific resonant frequencies.

OBJECTS OF THE INVENTION

Accordingly, it is the general object of the instant invention to provide electronic ballasts for fluorescent lighting which improves upon present electronic ballasts.

It is a further object of this invention to provide an electronic ballast for fluorescent lighting, each of which is capable of operating a bank or load of either two or four fluorescent lamps.

It is a further object of this invention to provide an electronic ballast that does not require lamp feedback.

It is another object of this invention to provide an electronic ballast that can be used as both a non-dimmable electronic ballast and a dimmable electronic ballast.

It is a further object of this invention to provide an electronic ballast for fluorescent lighting which is simple in construction.

It is a further object of this invention to provide an electronic ballast for fluorescent lighting which is low in cost.

It is still a further object of this invention to provide an electronic ballast for fluorescent lighting which incorporates more safety and protection against equipment failure or short circuits than existing electronic ballasts.

It is still another object of this invention to provide an electronic ballast that does not require a 50 Hz nor a 60 Hz power source be wired to any of the lamp fixtures.

It is still another object of this invention to provide an electronic ballast that does not expose someone replacing a fluorescent lamp to the dangers of a 50 Hz nor a 60 Hz power source.

It is still another object of this invention to provide an electronic ballast for fluorescent lighting which effectively protects against noise and interference to electronic equipment in the facility where the fluorescent lamps are installed.

It is still another object of this invention to provide an electronic ballast for fluorescent lighting which exhibits a positive and rapid start-up when power is applied.

It is still another object of this invention to provide an electronic ballast for fluorescent lighting which is capable of restarting the lamps in a very short time period after the power has been turned off.

It is still another object of this invention to provide an electronic ballast for fluorescent lighting which does not present a shock or electrocution hazard when the fluorescent lamps are removed from their sockets leaving the sockets exposed.

It is yet another object of this invention to provide dimmable and non-dimmable electronic ballasts for fluorescent lighting which achieve the above objects.

It is yet another object of this invention to provide a dimmable/non-dimmable electronic ballast for fluorescent lamps including a control which can be located at a central location remote from the fluorescent lamp load.

It is yet another object of this invention to provide a dimmable ballast for fluorescent lighting which does not exhibit points of resonance over the range of frequencies applied to the fluorescent lamps to effect their dimming control.

It is still yet another object of this invention to provide an electronic ballast that operates all of the fluorescent lamp filaments at their optimum temperature regardless of the intensity of the light at which they are set to operate.

It is still yet another object of this invention to provide an electronic ballast that utilizes high frequency current limiting reactors that replace feedback systems that are used in some conventional electronic ballasts for adjusting the lamp voltage from the high electrical discharge start voltage to the lower maintenance voltage to keep the lamp lit.

SUMMARY OF THE INVENTION

These and other objects of the instant invention are achieved by providing an electronic ballast for operating a lighting load of at least two fluorescent lamps. The ballast comprises (a) a protection and noise filter circuit arranged to be connected to an AC power source for generating a filtered AC power signal; (b) a rectifier and DC filter circuit coupled to the protection and noise filter circuit to provide two levels of DC power from said AC power signal; (c) a voltage-to-frequency circuit coupled to the rectifier and DC filter circuit and whereby the voltage-to-frequency circuit uses one of the two levels of DC power to generate a high frequency output signal; (d) an inverter circuit coupled to the rectifier and DC filter circuit and to the voltage-to-frequency circuit wherein the inverter circuit is activated by the high frequency output signal to generate a high frequency lamp power signal from the other level of DC power provided by the rectifier and DC filter circuit; and (e) an output circuit coupled to the inverter circuit and comprising an output transformer coupled to the lamps and arranged for maintaining a constant voltage of the high frequency lamp power signal independent of the high frequency.

These and other objects of the instant invention are achieved by providing a method for operating a lighting load of at least two fluorescent lamps. The method comprises the steps of: (a) filtering a power signal provided from an AC power source; (b) rectifying the filtered power signal into two levels of DC power; (c) using one of the two levels of DC power to activate an inverting means to generate a high frequency lamp power signal from the other of two levels of DC power; and (d) maintaining the voltage level of the high frequency lamp power signal independent of the high frequency.

DESCRIPTION OF THE DRAWINGS

Other objects and many of the intended advantages of this invention will be readily appreciated when the same becomes better understood by reference to the following detailed description when considered in connection with the accompanying drawings wherein.

DETAILED DESCRIPTION OF THE PREFERRED EMBODIMENTS

The present invention represents an improvement over the invention disclosed in U.S. Pat. No. 5,825,137 (Titus) and incorporates by reference the entire disclosure of U.S. Pat. No. 5,825,137 (Titus).

Figure 1:
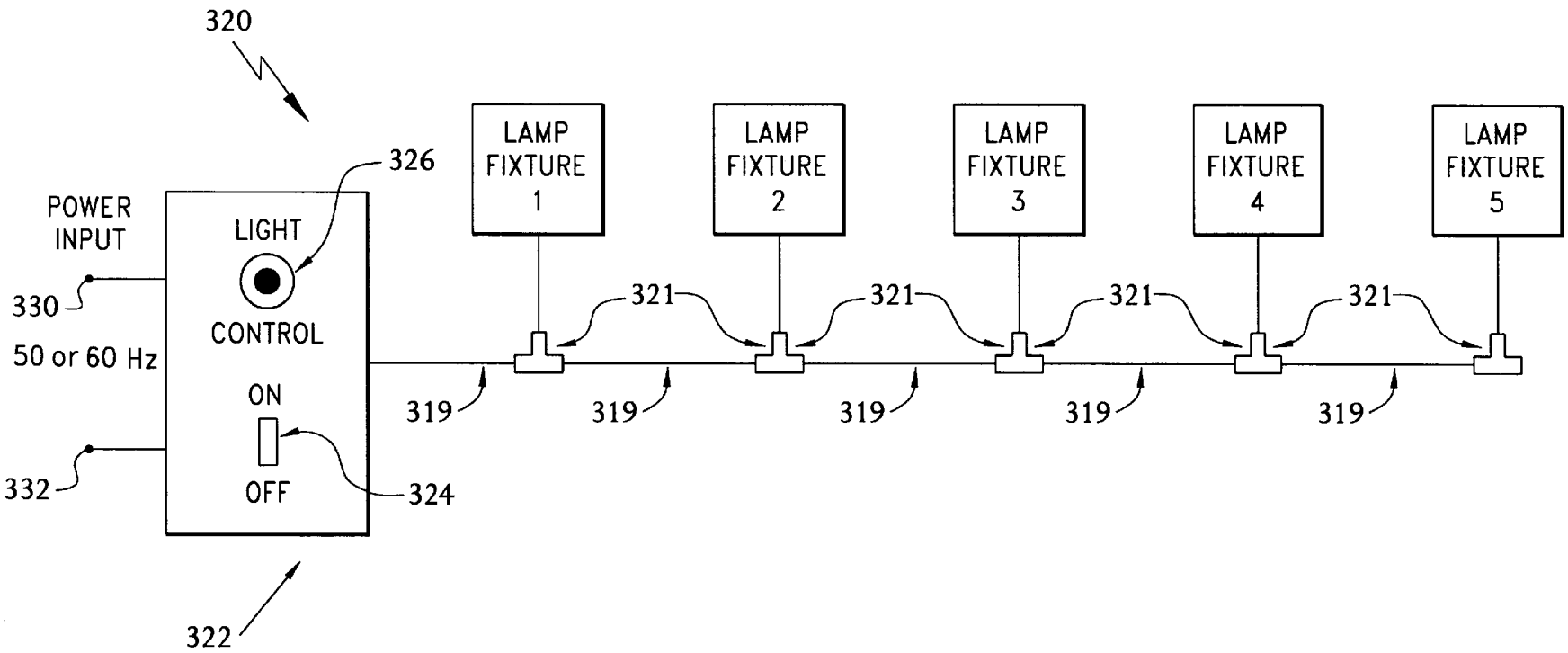
FIG. 1 is a block diagram of the electronic ballast constructed in accordance with this invention.

Referring now in greater detail to the various figures of the drawing, wherein like reference characters refer to like parts, there is shown at 320 in FIG. 1 a preferred embodiment of an electronic ballast, that can be used as both a non-dimmable ballast or a dimmable ballast, for electronic fluorescent lighting. The electronic ballast 320 is operated by a controller 322 having an on/off switch 324 and a light (dimmer) control 326. To act as a non-dimmable ballast, only the on/off switch 324 is activated by the user to turn on/off all lights connected to the ballast 320. To act as a dimmable ballast, the light control 326 is also manipulated by the user to adjust the appropriate lighting level. The controller 322 controls at least one fluorescent lamp fixture (e.g., lamp fixture 1), or may control a plurality of fluorescent lamp fixtures (lamp fixtures 1–5), via a high frequency cable 319; electrical T-couplings 321 are used to connect the lamp fixtures 1–5 to the high frequency cable 319. The number of fluorescent lamp fixtures that can be controlled by the ballast 320 depends upon the size of the power source (e.g., the 50/60 Hz power supply), the number of lamps and the cable 319 size for providing the requisite current level. By way of example and not limitation, the type of fluorescent lamps may comprise 40" length, 1½" diameter lamps or 36" length, 1" diameter lamps.

Figure 2A:
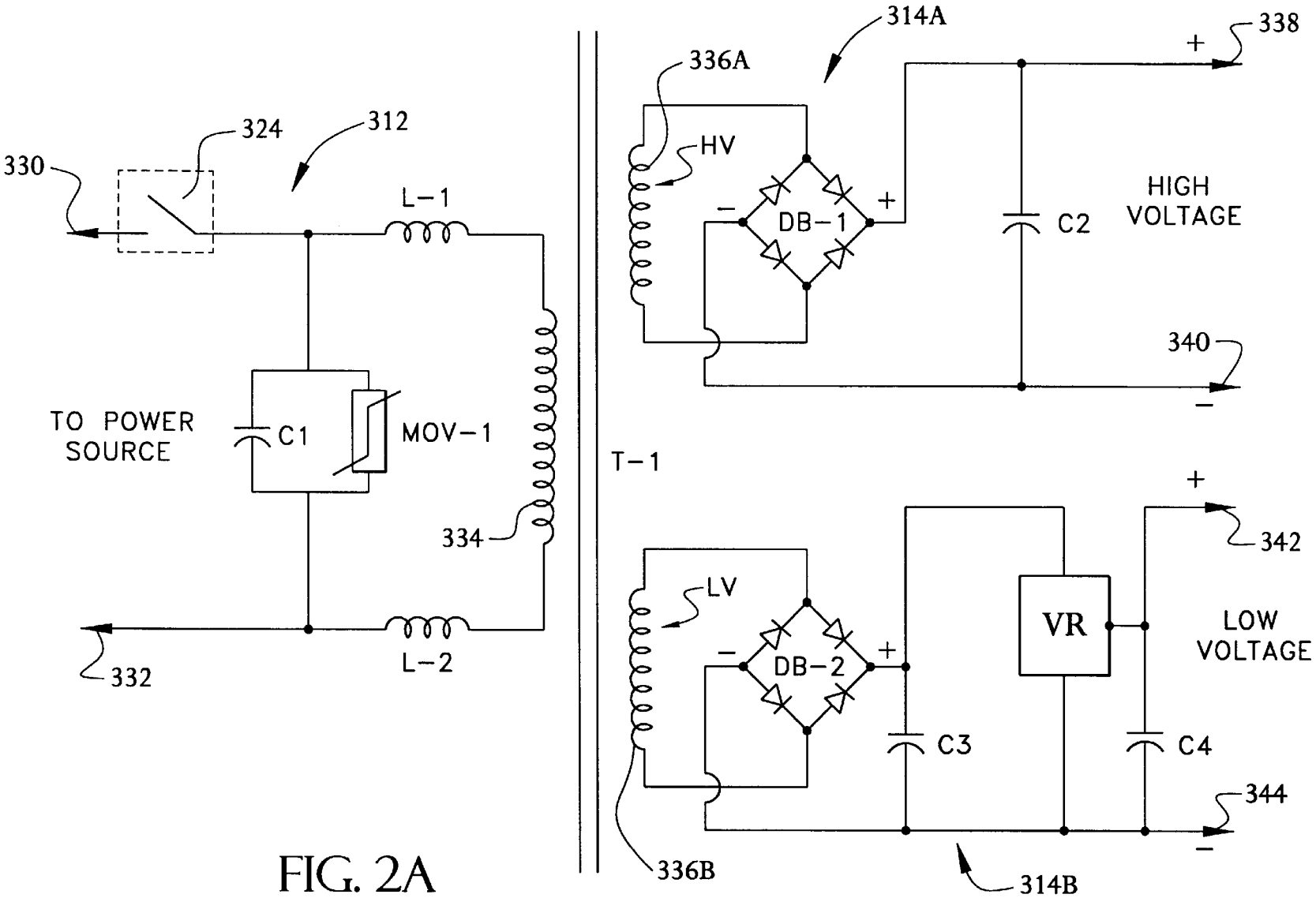
FIGS. 2A–2B together constitute a circuit diagram for the controller portion of the electronic ballast constructed in accordance with the invention.
Figure 2B:
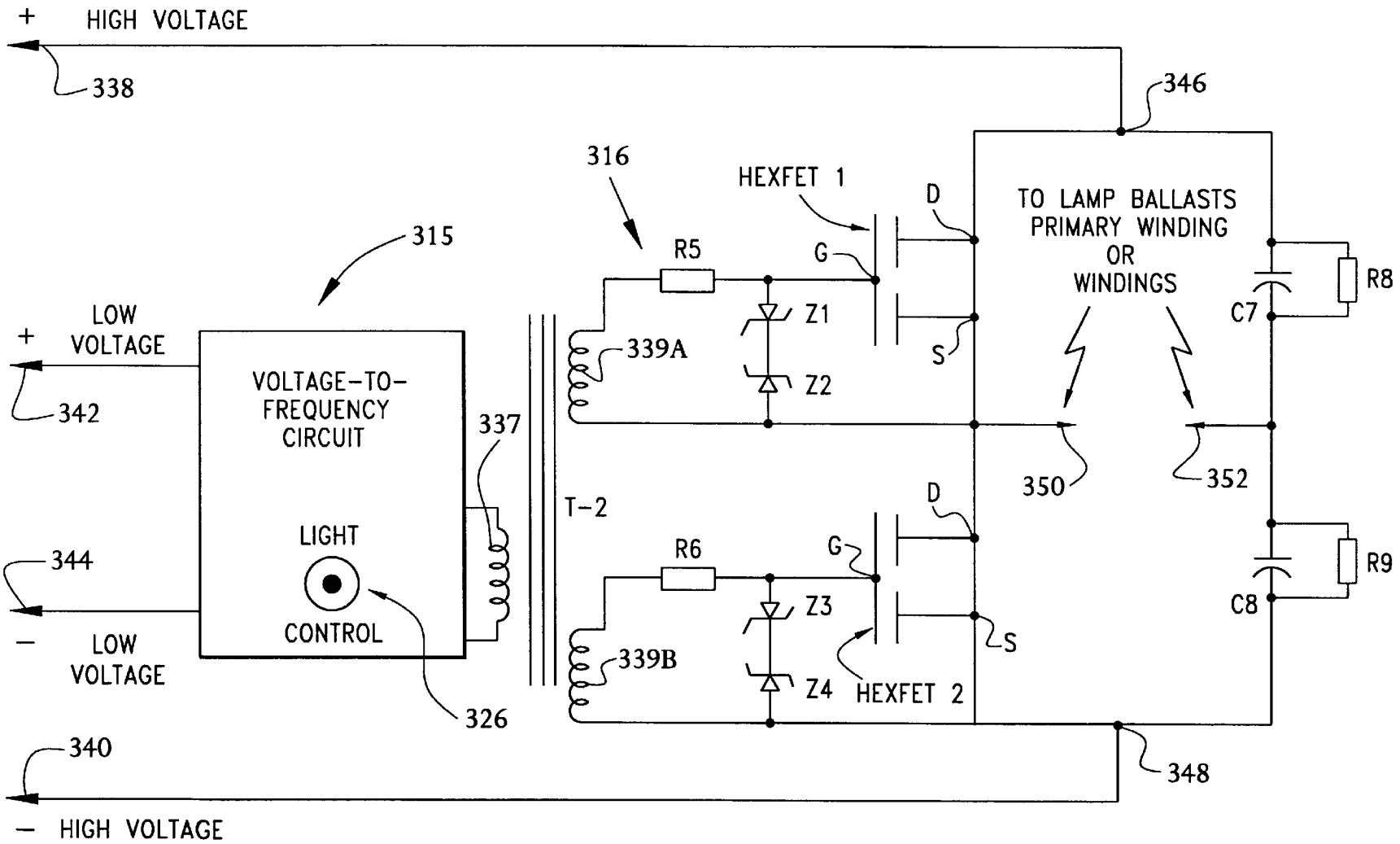
Figure 3:
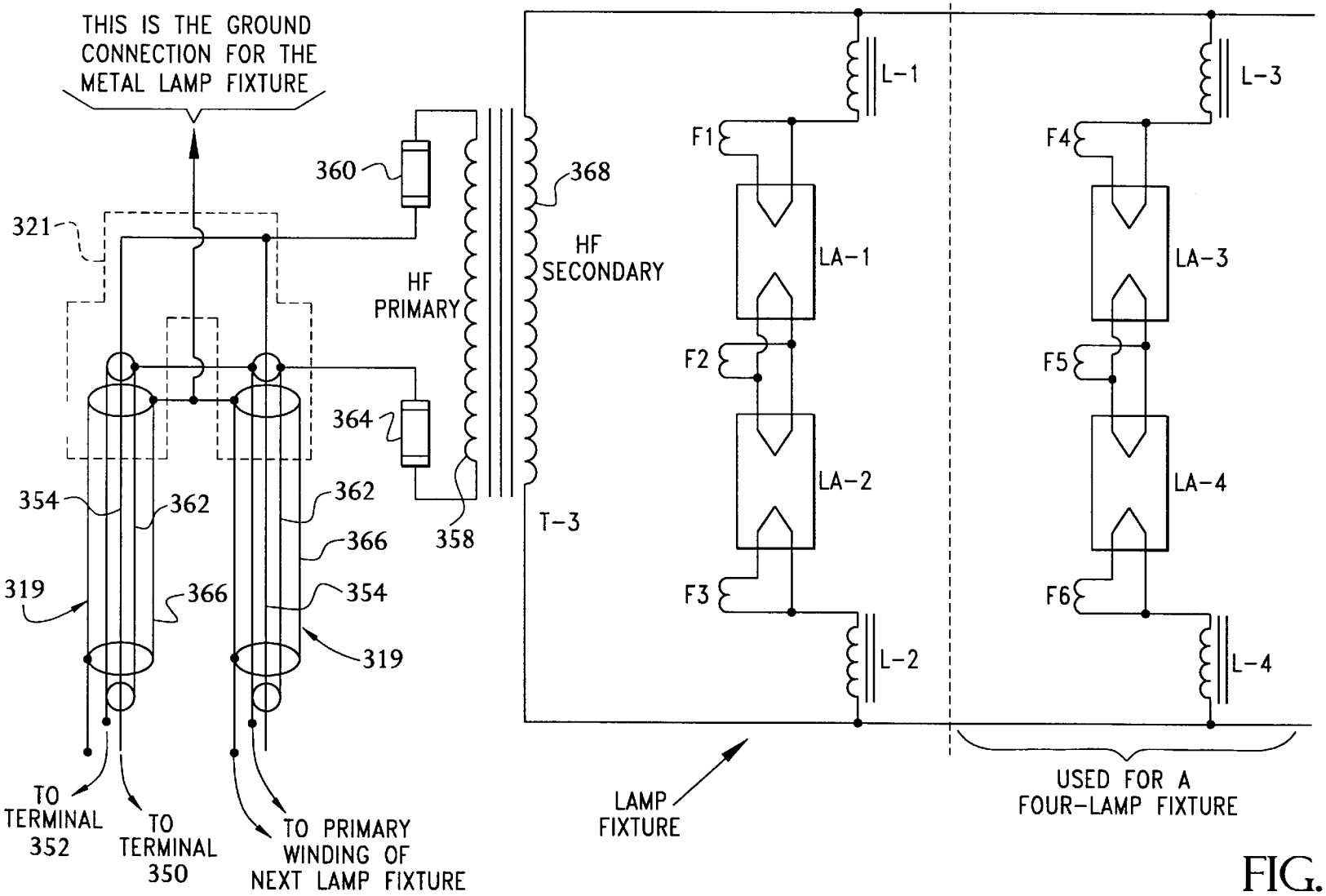
FIG. 3 is a circuit diagram for the lamp fixture portion of the present invention.

As shown in detail in FIGS. 2A–2B, the controller 322 (also known as the "master control unit") comprises a protection and noise filter circuit 312, a high DC voltage filter section 314A, a low DC voltage filter section 314B, a voltage-to-frequency circuit 315, and an inverter section 316. The output of the inverter section 316 is then electrically coupled to the lamp fixture 1 via the high frequency cable 319, as shown in FIG. 3. The on/off switch 324 is located in the protection and noise filter circuit 312 and the light control 326 is located in the voltage-to-frequency circuit 315. Two exemplary voltage-to-frequency circuits 315 are given in FIGS. 4A and 4B.

As shown in FIG. 3, each lamp fixture may comprise a two fluorescent lamp configuration (i.e., LA-1 and LA-2), or a four fluorescent lamp configuration (i.e., LA-1 through LA-4) connected in several ways. For example, in FIG. 3, there is shown one exemplary four-lamp load, wherein two conventional fluorescent lamps, LA-1 and LA-2, are connected in series with each other, and are connected in parallel to the series connection of two other conventional fluorescent lamps, LA-3 and LA-4. Alternatively, FIG. 3 depicts one exemplary two-lamp load on the left side of the dotted line. In this embodiment, two conventional fluorescent lamps, LA-1 and LA-2, are connected in series. It should be pointed out at this juncture that while the loads of FIG. 3 are preferred, other arrangements of multiple lamp loads (e.g., four lamps in series, or four lamps in parallel) can be driven by the ballast 320 of this invention. Moreover, the electronic ballast 320 can be used with any conventional source of AC power, e.g., 120V, 208V, 220V, 240V or 277V at 50 Hz to 60 Hz.

As shown in FIG. 2A, the input power, e.g., 50 Hz or 60 Hz, is coupled to the protection and noise filter circuit 312 at input terminals 330 and 332. A capacitor C1 and surge arrestor (which in the preferred embodiment shown herein is a metal-oxide-varistor) MOV-1 are coupled in parallel and are connected across the input terminals 330 and 332, following the on/off switch 324. The capacitor C1 and the MOV-1 surge arrestor are used to block bi-directional voltage and attenuate bi-directional electrical noise. A linear inductor L-1 is coupled in series with the primary winding 334 of a transformer T-1 which is connected in series with another linear inductor L-2. This series arrangement of L-1, the primary coil of T-1 and L-2 is coupled in parallel with C1 and MOV-1. As will be appreciated by those skilled in the art, the linear inductors L-1 and L-2 in coordination with the capacitor C1 constitute an electrical noise reduction filter system. This system serves to prevent surges from the AC power system from entering the ballast 320 and either damaging it or causing it to malfunction. In addition, the protection and noise filter section 312 prevents electrical noise which may be generated in the ballast 320 from propagating back into the AC power system, which action might disturb sensitive electronic equipment, such as computers, and the like, connected to the power system.

The filtered power input is then transformed via transformer T-1 from the primary winding 334 to two secondary windings 336A and 336B. In particular, secondary winding 336A transforms the filtered power input and supplies it to a diode bridge rectifier circuit DB-1 which generates a high DC voltage output across terminals 338 and 340. By way of example only, where a 120VAC 60 Hz power input is used, the output of the DB-1 is approximately $280VDC_{open\ circuit}$ and $180VDC_{loaded}$. This high DC voltage is used to drive the inverter circuit 316 (FIG. 2B). Capacitor C2 filters out the ripple and supplies the high DC voltage required to power: (a) the inverter HEXFET-1 and HEXFET-2; (b) capacitors C7 and C8 and (3) their voltage discharge resistors R8 and R9 (FIG. 2B).

The secondary winding 336B transforms the filtered power input and supplies it to a diode bridge rectifier DB-2 which generates a low DC voltage. By way of example only, where a 120VAC 60 Hz power input is used, the output of the DB-2 is approximately 12VDC–18VDC. This DB-2 output is fed through a voltage regulator (VR) that provides a constant low DC voltage (e.g., 15VDC) across terminals 342 and 344 for driving the voltage-to-frequency circuit 315 (FIG. 2B). Capacitor C3 filters the DC ripple and then supplies the filtered signal to the voltage regulator VR. Capacitor C4 acts to further filter the output of the VR. Thus, both of these secondary windings 336A/336B supply the proper voltage and current to their respective rectifiers.

Figure 4A:
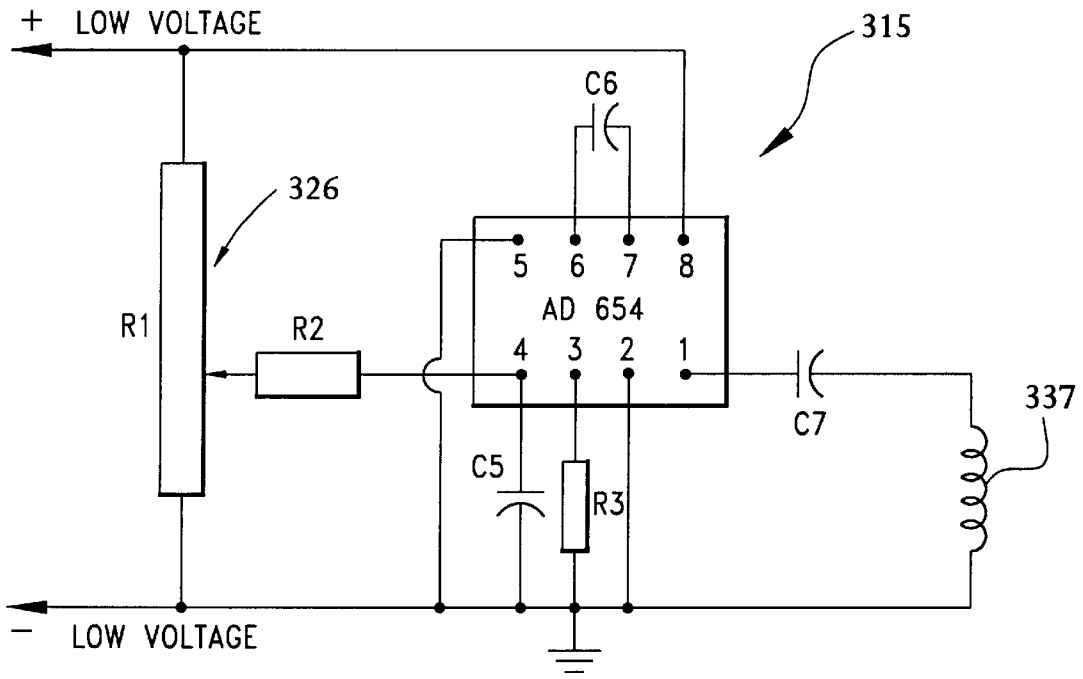
FIG. 4A is a circuit diagram for a voltage-to-frequency circuit.
Figure 4B:
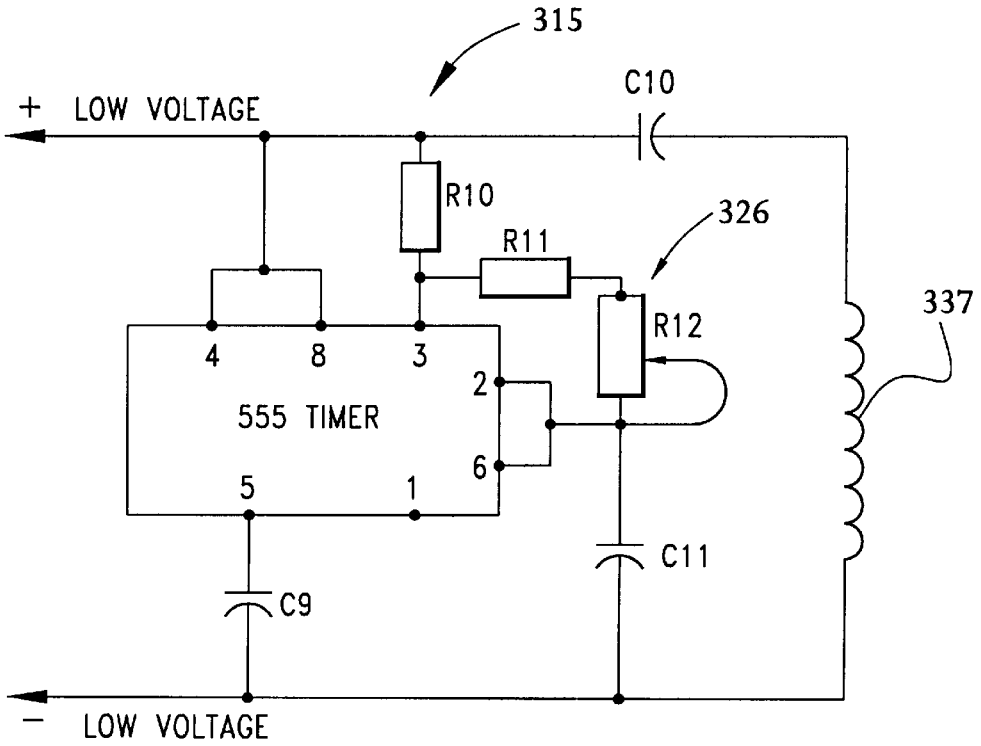
FIG. 4B is alternative circuit schematic for the voltage-to-frequency.

As shown in FIG. 2B, the voltage-to-frequency circuit 315 provides an alternating signal (e.g., a square wave output) for controlling the operation of the inverter circuit 316, comprising a pair of power MOSFETs: HEXFET-1 and HEXFET-2, each having a respective gate (G), drain (D) and source (S) terminal. (HEXFET is a trademark of International Rectifier). Depending upon the particular implementation of the voltage-to-frequency circuit 315, the alternating signal can be in the range of 20 kHz to 250 kHz. FIG. 4A provides a first embodiment for implementing the voltage-to-frequency circuit 315 whereby an AD654 (Analog Devices, voltage-to-frequency square wave output, single supply/500 kHz FS) IC chip is used. Alternatively, as shown in FIG. 4B, a 555 timer IC is used. The alternating signal output of the voltage-to-frequency circuit 315 is transformed from a primary winding 337 of a transformer T-2 to the inverter circuit 316 via respective secondary windings 339A and 339B for each HEXFET. In each voltage-to-frequency embodiment, the dimmer control 326 comprises a manually-adjustable element(s) (e.g., a rheostat or a potentiometer such as R-1/R-2 in FIG. 4A or R12 in FIG. 4B) that permit the input voltage to the voltage-to-frequency integrated circuit to be varied by the user to adjust the output frequency, and thus the light intensity, as will be discussed in detail later.

Operation of the inverter circuit 316 is similar to the operation of the inverter section 16 described in U.S. Pat. No. 5,825,137 (Titus) and which is incorporated by reference herein. However, instead of using a resonant circuit comprising the multi-tapped inductor L4 and capacitor C4 of U.S. Pat. No. 5,825,137 (Titus), the present invention 320 utilizes the alternating signal, in the range of 20 kHz–250 kHz, from the voltage-to-frequency circuit 315 for alternating the turning on/off of HEXFET 1 and HEXFET 2, respectively. When at least one lamp fixture (e.g., lamp fixture 1) is connected to controller terminals 350 and 352 via the high frequency cable 319, the alternate activation of HEXFET 1 and HEXFET 2 by the voltage-o-frequency circuit 315 output generates high frequency (between 20 kHz and 250 kHz) lamp power for the lamp fixture(s) (e.g., lamp fixtures 1–5) from the high DC voltage available at points 346 and 348.

As shown in FIG. 3, the high frequency lamp power from terminals 350 and 352 are sent through the high frequency cable 319 to the first lamp fixture, namely lamp fixture 1. The high frequency cable 319 may comprise a shielded twisted pair, a coax cable or a triax-type of cable. The following is an exemplary type of high frequency cable and is by way of example and not limitation. The high frequency triax cable 319 comprises a central conductor 354 that is coupled to terminal 350 at one end and connected at its other end to one side of a high frequency ballast primary winding 358 via a fuse 360. The high frequency cable 319 also comprises an outer conductor 362 that is coupled to terminal 352 at one end and connected at its other end to the other side of the high frequency ballast primary winding 358 via a fuse 364. An outer sheath 366 of the cable 319 is connected to a ground connection (not shown) for the metal lamp fixture. The next lamp fixture, e.g., lamp fixture 2, is connected similarly, via an electrical T-coupling 321. Thus, a plurality of lamp fixtures (e.g., lamp fixtures 1–5) are "daisy-chained" together using the high frequency triax cable 319 configuration.

The transformer T-3 comprises the high frequency ballast primary winding (HF Primary) 358 and a high frequency ballast secondary winding (HF secondary) 368. The use of the transformer T-3 provides isolation between the controller 322 and the lamp fixtures 1–5. It should be understood that each filament winding (F1–F3 for a two-lamp fixture and F1–F6 for a four-lamp fixture) are wound about the same core as the HF secondary 368; each filament winding comprises a small-turn (e.g., two-turn) coil. As shown in FIG. 3, one side of the HF secondary 368 is connected to a reactor L-1 while the other side of the HF secondary 368 is connected to a reactor L-2. The reactors L-1 and L-2 are separate and independent from the filament windings F1–F6, i.e., reactors L-1 and L-2 are not wound around the same core as the HF secondary 368 and filament windings F1–F6.

The reactors L-1 and L-2 may share a common iron core or may have respective cores. Reactor L-1 is connected to filament winding F1 which forms one filament of lamp LA-1. Filament winding F2 is connected to the other filament of lamp LA-1 and to one filament of lamp LA-2. Filament winding F3 is connected to reactor L-2 and is connected to the other filament of lamp LA-2. Reactors L-3 and L-4 are similar to reactors L-1 and L-2 and are connected in a similar manner with lamps LA-3 and LA-4 and their respective filaments and filament windings. The transformer T-3, reactors L-1 through L-4 and filament windings F1–F6 form an output circuit to the electronic ballast 320.

The light intensity of the fluorescent lamps is a function of the discharge current through the lamps. Thus, as the current increases so does the light intensity and vice versa. By holding the voltage constant at the ballast, and since voltage V is defined as I (current)×Z (impedance), the present invention 320 permits the user to dim the lamps (i.e., increase the frequency) by holding the voltage constant which, in turn, decreases the current to the lamps; or in the alternative, to brighten the lamps (i.e., decrease the frequency) by also holding the voltage constant which, in turn, increases the current.

In particular, the function of the reactors L-1 and L-2 (as well as reactors L-3 and L-4) is to place impedance into the ballast circuit so that as frequency increases, so does impedance since Z (impedance)=$j\omega L$, where $j\omega$ represents the radian frequency that is itself defined by $2\pi f$, where f is the frequency. In essence, the electronic ballast 320 of the present invention provides a constant voltage at the HF primary and secondary windings 358/368 (approximately 400 VAC) because as the user varies the frequency using the dimmer control 324, the reactors L-1 and L-2 (as well as L-3 and L-4) increase or decrease the impedance correspondingly to maintain the voltage at the HF primary/secondary windings 358/368. Furthermore, since the filament windings F1–F6 are also wound around the same core as the HF secondary 368, the voltage across each of them also remains constant (e.g., approximately 3 VAC).

Thus, another important feature of the present invention 320 is that the voltage of the daisy chain is also constant and independent of the frequency of the high frequency lamp power.

It should be noted that the higher the frequency, the lower is the light intensity and the lower is the power consumption of the lamp fixture. Furthermore, the life of a fluorescent lamp can be reduced significantly if one or both of the filaments in each fluorescent lamp is not operated at its optimum temperature. The circuits in the ballast 320 operate all of the lamp filaments at their optimum temperature regardless of the intensity of the light at which they are set to operate.

Another important feature of the electronic ballast 320 is that there is no 50 or 60 Hz power at any of the light fixtures themselves. Thus, any person replacing a fluorescent lamp that is connected to the electronic ballast 320 will not be subjected to the lethal danger of the 50 or 60 Hz power; rather, if the person should come into contact with a live high frequency electrical circuit in the fluorescent lamp connected to the electronic ballast 320, because there is only high frequency at the fluorescent lamp, it is possible that the person may receive a minor skin burn (e.g., similar to that received when a doctor uses an electric needle for cauterization), but will not be exposed to the lethal danger of the 50 or 60 Hz power.

The ballast 320 can operate either two lamps in series or four lamps in a series, parallel configuration.

The ballast 320 described above provides one high frequency power source for all of the lamp fixtures (e.g., lamp fixtures 1–5) located in a particular area which requires the same light intensity. If it is desired to directly turn off a particular lamp fixture while the other lamp fixtures remain on, conventional switches (not shown) can be installed between the T-couplings 321 and the lamp fixture. Thus, as an example, if it is desirable to be able to shut off lamp fixture 2 when the other remaining lamp fixtures remain on, such a switch can be installed between lamp fixture 2 and its corresponding T-coupling 321.

Finally, it should be understood that the electronic ballast 320 of the present invention is simple in construction and does not feed back any signal from any fluorescent lamp from any of the lamp fixtures.

Without further elaboration, the foregoing will so fully illustrate my invention and others may, by applying current or future knowledge, readily adapt the same for use under various conditions of service.

I claim:

1. An electronic ballast for operating a lighting load of at least two fluorescent lamps, said ballast comprising:

(a) a protection and noise filter circuit arranged to be connected to an AC power source for generating a filtered AC power signal;

(b) a rectifier and DC filter circuit coupled to said protection and noise filter circuit to provide two independent levels of DC power from said filtered AC power signal;

(c) a voltage-to-frequency circuit coupled to said rectifier and DC filter circuit, said voltage-to-frequency circuit using one of said two levels of DC power to generate an output signal of a high frequency;

(d) an inverter circuit coupled to said rectifier and DC filter circuit and to said voltage-to-frequency circuit, said inverter circuit being activated by said output signal to generate a lamp power signal of said high frequency from said other level of DC power provided by said rectifier and DC filter circuit; and (e) an output circuit coupled to said inverter circuit and comprising an output transformer coupled to said lamps and arranged for maintaining a constant voltage of said lamp power signal independent of changes to said high frequency.

2. The electronic ballast of claim 1 wherein said output transformer comprises means for varying impedance in said ballast in accordance with the changes to said high frequency.

3. The electronic ballast of claim 2 wherein said output transformer comprises a secondary winding and wherein said means for varying impedance comprises a pair of reactors coupled thereto.

4. The electronic ballast of claim 3 wherein said secondary winding is wound around a core and wherein each of said at least two fluorescent lamps comprises a respective filament winding wound around the same core as said secondary winding, said secondary winding having a first reactor coupled between one side of said secondary winding and one of said filament windings and said secondary winding having a second reactor coupled between the other side of said secondary winding and the other filament winding.

5. The electronic ballast of claim 1 wherein said two levels of DC power comprise a high DC power level and a low DC power level.

6. The electronic ballast of claim 5 wherein rectifier and DC filter circuit comprises a first rectifier circuit for generating said high DC power level and a second rectifier circuit for generating a low, constant DC power level.

7. The electronic ballast of claim 6 wherein said low, constant DC power level is provided to said voltage-to-frequency circuit.

8. The electronic ballast of claim 5 wherein said inverter circuit uses said high DC power level to generate said lamp power signal.

9. The electronic ballast of claim 1 wherein said rectifier and DC filter circuit is coupled to said protection and noise filter circuit through a transformer.

10. The electronic ballast of claim 1 wherein said voltage-to-frequency circuit is coupled to said inverter circuit through a transformer.

11. The electronic ballast of claim 1 wherein said inverter circuit comprises a pair of power metal oxide semiconductor field effect junction transistors arranged to be activated alternately by said output signal to generate said lamp power signal.

12. The electronic ballast of claim 6 wherein said rectifier and DC filter circuit comprise a voltage regulator for generating said low, constant DC power level.

13. The electronic ballast of claim 1 wherein said voltage-to-frequency circuit generates said output signal wherein said high frequency is in the range of 20 kHz to 250 kHz.

14. The electronic ballast of claim 1 wherein said voltage-to-frequency circuit comprises a voltage-to-frequency integrated circuit.

15. The electronic ballast of claim 14 wherein said voltage-to-frequency integrated circuit generates said output signal wherein said high frequency is in the range of 20 kHz to 250 kHz.

16. The electronic ballast of claim 1 wherein said protection and noise filter circuit comprise an on/off switch.

17. The electronic ballast of claim 1 wherein said voltage-to-frequency circuit comprises a user-adjustable member for altering light intensity of said at least two fluorescent lamps.

18. The electronic ballast of claim 1 further comprising a first high frequency cable for coupling said inverter circuit to said output transformer having a primary winding, said first high frequency cable comprising an inner conductor that is connected to one side of said primary winding and an outer conductor that is connected to the other side of said primary winding.

19. The electronic ballast of claim 18 wherein another pair of said at least two fluorescent lamps, remotely located from said at least two fluorescent lamps, are coupled to said at least two fluorescent lamps in a daisy chain configuration so that said at least two fluorescent lamps and said another pair of said at least two fluorescent lamps are controlled by said ballast.

20. The electronic ballast of claim 19 further comprising a T-coupling, said T-coupling permitting another high frequency cable coupled to said another pair of said at least two fluorescent lamps to be coupled to said first high frequency cable to form said daisy chain configuration.

21. The electronic ballast of claim 1 wherein said power signal from said AC power source is in the range of 50 to 60 Hz and at 110, 208, 220, 240 or 277 volts, said protection and noise filter circuit having a first and a second terminal to which said AC power source is connected.

22. The electronic ballast of claim 21 wherein said output circuit is arranged for providing protection against shock or electrocution when said fluorescent lamps are removed, said output transformer comprising a primary winding having a first end and a second end and to which said inverter circuit is connected and a secondary winding having a first end and a second end connected to said fluorescent lamps, said secondary winding being isolated from said primary winding and said AC power source.

23. The electronic ballast of claim 1 wherein said protection and noise filter circuit, said rectifier and DC filter circuit, said voltage-to-frequency circuit, and said inverter circuit are all located in a single unit.

24. The electronic ballast of claim 23 wherein said single unit is located remotely from said at least two fluorescent lamps.

25. A method for operating a lighting load of at least two fluorescent lamps, said method comprising the steps of:

(a) filtering a power signal provided from an AC power source;

(b) rectifying said filtered power signal into two levels of DC power;

(c) using one of said two levels of DC power to generate a control signal of a high frequency that activates an inverter to generate a lamp power signal of said high frequency from said other of two levels of DC power; and (d) maintaining the voltage level of said lamp power signal independent of changes to said high frequency.

26. The method of claim 25 wherein said high frequency is in the range of 20 kHz to 250 kHz.

27. The method of claim 25 wherein said one of said two levels of DC power comprises a low, constant DC power level that is used to generate said high frequency control signal that activates said inverter.

28. The method of claim 27 wherein said other of said two levels of DC power comprises a high DC power level from which said lamp power signal is generated.

29. The method of claim 28 wherein said step of using one of said two levels of DC power to generate a control signal of a high frequency comprises feeding said low, constant DC power level into a voltage-to-frequency circuit.

30. The method of claim 29 wherein said step of using one of said two levels of DC power to generate a control signal of a high frequency further comprises feeding the output of said voltage-to-frequency circuit into another circuit comprising a pair of power MOSFETs that operate in alternation to generate said lamp power signal from said high DC power level.

31. The method of claim 25 wherein said step of maintaining the voltage level of said lamp power signal independent of changes to said high frequency comprises providing an output transformer including a primary winding coupled to said inverter and including a secondary winding having a first end coupled to one side of said at least two fluorescent lamps through a first reactor and having a second end coupled to the other side of said at least two fluorescent lamps through a second reactor.

32. The method of claim 25 wherein said power signal from said AC power source is in the range of 50 to 60 Hz and at 110, 208, 220, 240 or 277 volts.

33. The method of claim 32 further comprising the step of preventing said AC power signal in the range of 50 to 60 Hz from appearing at said at least two fluorescent lamps.

34. The method of claim 25 wherein said at least two fluorescent lamps form a first light fixture and wherein a second pair of two fluorescent lamps form a second light fixture, said second light fixture being linked to said first light fixture in a daisy chain configuration.

* * * * *